US010615492B2

(12) United States Patent
Kerselaers et al.

(10) Patent No.: US 10,615,492 B2
(45) Date of Patent: Apr. 7, 2020

(54) MULTI-BAND, SHARK FIN ANTENNA FOR V2X COMMUNICATIONS

(71) Applicants: NXP B.V., Eindhoven (NL); NANYANG TECHNOLOGICAL UNIVERSITY, Singapore (SG)

(72) Inventors: Anthony Kerselaers, Herselt (BE); Yilong Lu, Singapore (SG); Yi Hua, Singapore (SG); Ling Huang, Singapore (SG)

(73) Assignee: NXP B.V., Eindhoven (NL)

( * ) Notice: Subject to any disclaimer, the term of this patent is extended or adjusted under 35 U.S.C. 154(b) by 0 days.

(21) Appl. No.: 16/039,277

(22) Filed: Jul. 18, 2018

(65) Prior Publication Data

US 2020/0028248 A1 Jan. 23, 2020

(51) Int. Cl.

| | |
|---|---|
| ***H01Q 1/32*** | (2006.01) |
| ***H01Q 1/52*** | (2006.01) |
| ***H01Q 1/12*** | (2006.01) |
| ***H01Q 1/24*** | (2006.01) |
| ***H01Q 5/35*** | (2015.01) |
| ***H01Q 21/06*** | (2006.01) |

(52) U.S. Cl.

CPC ..... *H01Q 1/3275* (2013.01); *H01Q 1/1214* (2013.01); *H01Q 1/241* (2013.01); *H01Q 1/523* (2013.01); *H01Q 5/35* (2015.01); *H01Q 21/064* (2013.01)

(58) Field of Classification Search

CPC ..... H01Q 1/3275; H01Q 5/35; H01Q 1/1214; H01Q 1/241; H01Q 1/523

USPC ..... 343/713

See application file for complete search history.

(56) References Cited

U.S. PATENT DOCUMENTS

| | | | | |
|---|---|---|---|---|
| 6,121,935 A * | 9/2000 | Reece | H01Q 1/38 | 343/725 |
| 6,198,437 B1 * | 3/2001 | Watson | H01Q 1/38 | 343/700 MS |
| 7,034,758 B2 * | 4/2006 | Haidacher | H01Q 1/3275 | 343/700 MS |

(Continued)

OTHER PUBLICATIONS

D.V. Navarro-Mendez et al., "Compact Wideband Vivaldi Monopole for LTE Mobile Communications," in IEEE Antennas and Wireless Propagation Letters, vol. 14, pp. 1068-1071, 2015.

(Continued)

*Primary Examiner* — Huedung X Mancuso

(74) *Attorney, Agent, or Firm* — Rajeev Madnawat

(57) ABSTRACT

A multi-band antenna suitable for use by vehicles has ports for Wi-Fi and DSRC signals, cellular signals, and GPS signals. A base substrate forms a ground plane, and a shark-fin shaped radiating substrate is transversely aligned with the base substrate. On a first side of the radiating substrate there is a first conductive feed strip with a vertical extending portion that is galvanically connected to the first port, and a second conductive feed strip that is galvanically connected to the second port. On a second side of the radiating substrate there is a first wide-slot that is capacitively coupled to the first and second feed strips, is galvanically connected to the base conductor, and overlaps with at least the extending-portion of the first feed strip. There also is a second wide-slot on the second side that extends from a back edge to a location between the first and second ports.

20 Claims, 5 Drawing Sheets

(56) References Cited

U.S. PATENT DOCUMENTS

| | | | | |
|---|---|---|---|---|
| 7,084,830 | B1 * | 8/2006 | Suh | H01Q 1/38 343/812 |
| 7,333,065 | B2 | 2/2008 | Lindackers et al. | |
| 8,081,126 | B2 | 12/2011 | Ikeda et al. | |
| 8,125,404 | B2 | 2/2012 | Chen et al. | |
| 8,248,315 | B2 | 8/2012 | Lindackers et al. | |
| 8,319,693 | B2 | 11/2012 | Chakam et al. | |
| 8,537,062 | B1 * | 9/2013 | Duzdar | H01Q 1/3275 343/713 |
| 8,686,907 | B2 * | 4/2014 | Jan | H01Q 1/521 343/713 |
| 9,083,414 | B2 | 7/2015 | Basnayake et al. | |
| 9,680,201 | B2 * | 6/2017 | Kaneko | H01Q 1/3275 |
| 9,806,404 | B2 | 10/2017 | Chakam et al. | |
| 9,985,350 | B2 * | 5/2018 | Nannetti | H01Q 5/307 |
| 2003/0098813 | A1 * | 5/2003 | Koskiniemi | H01Q 9/0421 343/702 |
| 2007/0001910 | A1 * | 1/2007 | Yamanaka | H01Q 9/0407 343/700 MS |
| 2008/0204328 | A1 * | 8/2008 | Nissinen | H01Q 1/38 343/700 MS |
| 2009/0096676 | A1 * | 4/2009 | Yan | H01Q 9/285 343/700 MS |
| 2009/0231201 | A1 * | 9/2009 | Annamaa | H01Q 1/243 343/700 MS |
| 2014/0292593 | A1 | 10/2014 | Thiam et al. | |
| 2016/0049732 | A1 * | 2/2016 | Huang | H01Q 9/0407 343/848 |
| 2017/0054216 | A1 * | 2/2017 | Shi | H01Q 3/2676 |

OTHER PUBLICATIONS

"Delphi Connectivity System," Retrieved from: https://www.delphi.com/manusystem, Jul. 26, 2017.

C.Y. Liou et al., "Compact and Low-Profile Conical Antenna for Automotive DSRC Application," 2016 IEEE International Symposium on Antennas and Propagation (APSURSI), Fajardo, 2016, pp. 117-118.

B. Sanz-Izquierdo et al., "Inkjet Printed and Folded LTE Antenna for Vehicular application," 2016 46th European Microwave Conference (EuMC), London, 2016, pp. 88-91.

A. Michel et al., "Printed Wideband Antenna for LTE Band Automotive Applications," in IEEE Antennas and Wireless Propagation Letters, vol. 16, pp. 1245-1248, 2017.

D.V. Navarro-Mendez et al., "Wideband Double Monopole for Mobile, WLAN, and C2C Services in Vehicular Applications," in IEEE Antennas and Wireless Propagation Letters, vol. 16, pp. 16-19, 2017.

O.Y. Kwon et al., "Integrated MIMO Antennas for LTE and V2V Applications," 2016 URSI Asia-Pacific Radio Science Conference (URSI AP-RASC) Seoul, 2016, pp. 1057-1060.

L. Mouffok et al., "Wideband Collocated Antennas for Radiation Pattern Diversity Applications," 2016 IEEE International Symposium on Antennas and Propagation (APSURSI), Fajardo, 2016, pp. 537-538.

S. Yoon et al., "Multi-Band Multi-Port Small Antnena Design," 2007 Asia-Pacific Microwave Conference (APMC), pp. 1-4, 2007.

K.H. Gamage et al., "Design of a Low Profile Multiband Antenna for Vehicular Communication System," 7th European Conf. on Antenna and Propagation (EuCAP), pp. 1273-1277, 2003.

E. Ghafari et al.,"A Vehicular Rooftop, Shark-fin, Multiband Antenna for the GPS LTE Cellular DSRC Systems," 2014 IEEE-APS Topical Conference on Antennas and Propagation in Wireless Communications (APWC), pp. 237-240, 2014.

S. Arianos et al., "Design of Multi-Frequency Compact Antennas for Automotive Communications," IEEE Trans. Antennas Propagation, vol. 60, pp. 5604-5612, 2012.

* cited by examiner

70

72

84

MULTI-BAND, SHARK FIN ANTENNA FOR V2X COMMUNICATIONS

BACKGROUND

The present invention relates to antennas, and, more particularly, to an antenna for a vehicle in an Intelligent Transportation System.

In an Intelligent Transportation System (ITS), vehicles are expected to be able to connect to everything (e.g., vehicle-to-everything (V2X)), which means that a vehicle should be able to connect to other vehicles, as well as with other road users and infrastructures. For example, modern vehicles are expected to be able to receive such signals as AM/FM radio signals, Global Positioning System (GPS) signals, wireless communication signals, such as 3G, 4G and LTE signals, and Wi-Fi. Modern vehicles also will be expected to communicate with other ITS infrastructures using Dedicated Short Range Communications (DSRC) for road safety and traffic efficiency. All these signals are transmitted at different frequencies, requiring various antennas for receiving these signals. However, having multiple antennas mounted all over the vehicle is costly and unsightly, so antennas that integrate multiple antennas into a shark-fin shaped housing have become popular.

A typical vehicle shark-fin unit has a length of 100 mm, width of 45 mm and height of 50/55 mm. This small size brings many challenges to the antenna design. For example, the smaller the distance is between antennas, the stronger the mutual coupling effects, and the lower the height of the unit, the more difficult it is to achieve low frequency applications. The limited space also makes it difficult to achieve a sufficient return loss and an omnidirectional radiation pattern. Thus, there has been many studies on antenna development for vehicular communications. However, none of the proposed designs with the desired footprint is able to cover all of the desired frequency bands, and provide adequate performance in both return loss and radiation patterns, and avoid mutual coupling among the multiple bands or antenna ports.

BRIEF DESCRIPTION OF THE DRAWINGS

The present invention, together with objects and advantages thereof, may best be understood by reference to the following description of embodiments thereof shown in the accompanying drawings. Elements in the drawings are illustrated for simplicity and clarity in order to provide a clear understanding of the invention, and therefore, may not always be drawn to scale, with some parts being exaggerated to facilitate understanding.

DETAILED DESCRIPTION

The present invention provides an integrated, compact, low-cost, multi-band antenna for vehicular applications suitable for a typical shark-fin unit. In one embodiment, the antenna has two ports supporting European cellular bands (both low and high band), Japan cellular band at 1.5 GHz, Wi-Fi-2.4 GHz band, Bluetooth band, Wi-Fi-5.0 GHz band, and DSRC band. Good performance is maintained with a small unit size. A prototype was constructed and simulated performance was validated via measurement results. In another embodiment, the antenna includes a third port for GPS band.

Figure 1:
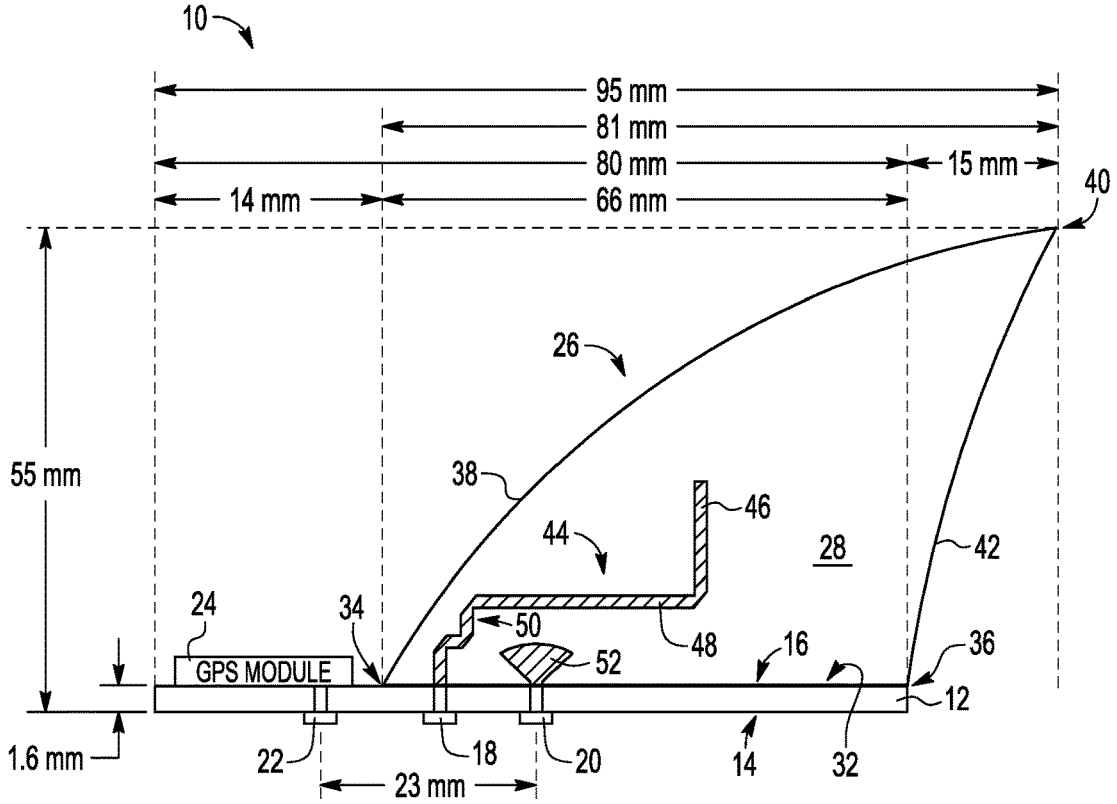
FIG. 1 is a right-side view of an antenna in accordance with an embodiment of the present invention.

Referring now to FIG. 1, a right-side view of a multi-band antenna 10 in accordance with a preferred embodiment of the invention is shown. The antenna 10 includes a base substrate 12 having lower and upper surfaces 14 and 16. In one embodiment, the base substrate 12 is a printed circuit board (PCB) having at least one insulating layer and at least one conductive layer. The insulating layer may be, for example FR4, which is known for its good insulating capabilities and high mechanical strength, while the one more conductive layers may be made of copper or a copper laminate. In one embodiment, the base substrate 12 includes base conductor, which is used as a ground plane. The base conductor may be formed on one of the lower or upper surfaces 14, 16, or even embedded between two insulating layers of the substrate 12. Thus, the base substrate 12 is formed from a low cost FR4 PCB having a thickness of around 1.6 mm and a dielectric constant of around 4.4. In one embodiment, the base substrate 12 has a size of around 80 mm×45 mm, and operates as a ground plane for the antenna 10 as well as the mainboard for the antenna 10. These dimensions are provided not to limit the scope of the invention, but to show that in the preferred embodiment, the antenna 10 fits within the chassis and cover of currently commercially used shark-fin antenna assemblies. Further, although the base substrate 12 is shown as being rectangular, it will be understood by those of skill in the art that the base substrate 12 may be shaped to fit within the footprint of current commercially used shark-fin antenna assemblies.

The base substrate 12 has a first port 18 located at a first location in the base substrate 12. The first port 18 allows for communicating first transmission signals in a first frequency band. A second port 20 is located at a second location in the base substrate 12 for communicating second transmission signals in a second frequency band that is different from the first frequency band. As will be explained further below, the first transmission signals of the first port 18 comprise Wi-Fi and Dedicated Short Range Communications (DSRC) frequency band signals, and the second transmission signals of the second port 20 comprise cellular frequency band signals that cover from 700 MHz to 1.2 GHz and 1.425 GHz to 2.7 GHz.

In one embodiment, there is an optional third port 22 disposed in the base substrate 12 for communicating third transmission signals. The third port 22 is connected to a Global Positioning System (GPS) antenna unit 24 mounted on the upper surface 16 of the base substrate 12. The GPS antenna unit 24 or GPS module, may be a stand-alone module of the type that is readily commercially available.

The ports 18, 20 and 22 can be equipped with various types of connectors, as desired, to connect the antenna 10 to a bus, such as an automotive CAN bus, or other automotive electronic components, as will be understood by those of skill in the art.

Figure 2:
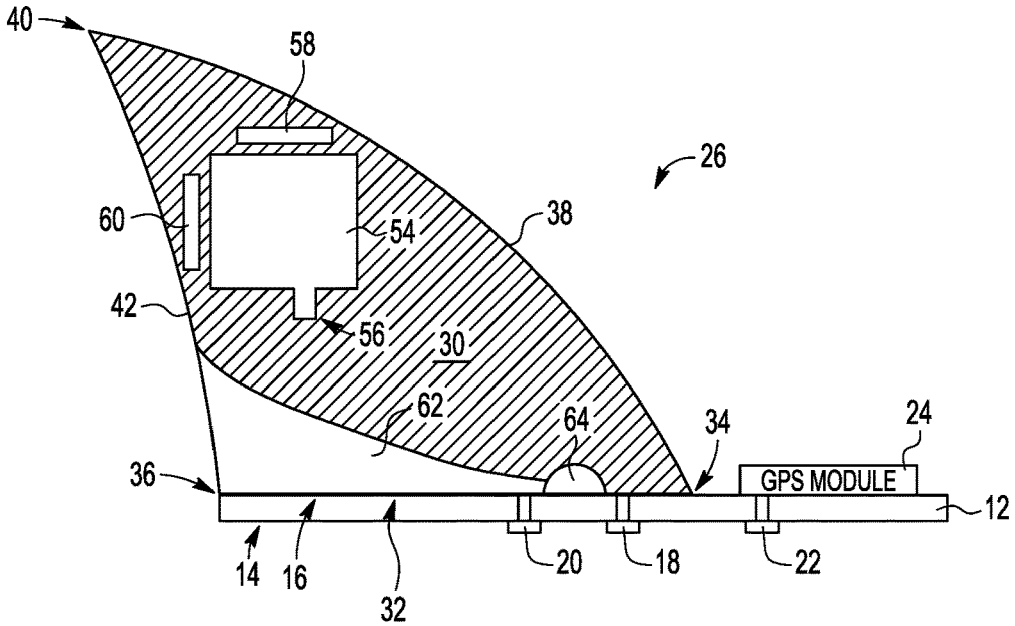
FIG. 2 is a left-side view of the antenna of FIG. 1.

Referring now to both FIGS. 1 and 2, where FIG. 2 is a left-side view of the antenna 10, the antenna 10 has a radiating substrate 26 that is transversely aligned with reference to the base substrate 12. The radiating substrate 26, like the base substrate 12, is formed from a low-cost PCB having conductive layer(s) and insulative layer(s), and has a thickness of about 1.6 mm.

The radiating substrate 26 includes first and second opposing major surfaces 28 and 30. The first major surface 28 (FIG. 1) is mainly an insulator, while the second major surface 30 is mostly a conductor (e.g., a copper foil sheet).

The radiating substrate 26 has a base edge 32 that is adjacent to the upper surface 16 of the base substrate 12. The base edge 32 extends between a front corner 34 and a back corner 36. A front edge 38 extends between the front corner 34 and a top corner 40. A back edge 42 extends between the back corner 36 and the top corner 40. The first and second major surfaces 28 and 30 are bounded by the base edge 32, the front edge 38 and the back edge 42. The front edge 38 is curved between the front corner 34 and the top corner 40. The top corner 40 is longitudinally aligned at a position that is beyond the back corner 36, such that the back edge 42 curves from the top corner 40 to the back corner 36, which gives the radiating substrate 26 the shark-fin shape. As can be seen, the first port 18 is located in the base edge 32 proximate to the front corner 34, the second port 20 is located in the base edge 32 between the first port 18 and the back corner 36, and the third port 22 is located in the base edge 32 near to the first port 18 but beyond the front corner 34. In one embodiment, the distance between the first and second ports 18 and 20 is about 23 mm.

Referring to FIG. 1, there is a first conductive feed strip 44 formed on the first major surface 28 that is galvanically connected to the first port 18. The first feed strip 44 has a vertical extending portion 46 at one end, followed by a long horizontal portion 48. The first feed strip 44 also has one or more smaller vertical and horizontal portions 50 disposed between the horizontal-portion 48 and the first port 18. The transitions between the one or more vertical and horizontal portions 50 are formed as right-angle bends with cut corners, which allow for positioning of the extending-portion 46. The extending-portion 46 also is offset from a center of the radiating substrate 26 in order to point a radiation pattern more to one side of the antenna 10.

A second conductive feed strip 52 is formed on the first major surface 28 of the radiating substrate 26. The second feed strip 52 is galvanically connected to the second port 20. The second feed strip 52 has a width that increases as a function of distance from the second port 20 such that the second feed strip 52 is fan-shaped.

Referring to FIG. 2, the second major surface 30 of the radiating substrate 26 is mostly a conductive surface that forms a first radiating patch. The first radiating patch is capacitively coupled to the first and second feed strips 44 and 52, and galvanically connected to the base substrate 12.

A generally rectangular, first wide-slot 54 is formed on a copper portion of the second major surface 30, such as by cutting. There is an additional small slot or notch 56 at the bottom side of the wide-slot 54. The first wide-slot 54 includes a narrow horizontal slot 58 that is spaced from and extends parallel to a horizontal side of the first wide-slot 54, and a narrow vertical slot 60 that is spaced from and extends parallel to a vertical side of the first wide-slot 54.

The first wide-slot 54 enables the antenna 10 to radiate at the first frequency band as a wide-slot monopole antenna. More specifically, the first wide-slot 54 allows the antenna 10 to radiate at Wi-Fi-2.4 GHz band, Wi-Fi-5 GHz band, and DSRC band. Thus, the first port 18 covers the Wi-Fi band from 2.4 GHz to 2.5 GHz and from 4.5 GHz to 6 GHz, which includes the Wi-Fi-5 GHz band and the DSRC band. The additional small slot or notch 56 at the bottom side of the wide-slot 54 is provided to improve the matching of the antenna 10 at the 2.4 GHz band.

The first wide-slot 54 also overlaps with at least the extending-portion 46 of the first feed strip 44, with the feed strip 44 preferably being offset from a center of the wide-slot 54 in order to point the radiation pattern more to one side of the antenna 10.

As the copper portion at the back side 30 is connected to the horizontal ground plane 12, the Wi-Fi-DSRC port 18 radiates as a wide-slot monopole antenna. However, the antenna 10 is shaped as a half-Vivaldi monopole antenna, because a conventional Vivaldi monopole antenna has a rectangular shape and thus does not fit in a shark-fin cover. The first port 18 covers Wi-Fi band from 2.4 GHz to 2.5 GHz and from 4.5 GHz to 6 GHz, which includes the Wi-Fi-5 GHz band and DSRC band.

A second wide-slot 62 is formed along the base edge 32 of the second major surface 30. The second wide-slot 62 extends from the back edge 42 to a location between the first and second ports 18 and 20. The second wide-slot 62 has a sloping curve from the back edge 42 to the base edge 32 at a location between the first and second ports 18 and 20. The second wide-slot 62 also has a half-circle shaped portion 64 located between the first and second ports 18 and 20.

By controlling the length of different sections of the first feed strip 44, the position of the wide-slot 54 can be varied and the offset also can be changed. In this case, the radiation patterns as well as the matching will be varied. The horizontal and vertical narrow slots 58 and 60 are for further control and optimization of the radiation patterns of the wide-slot 54 for Wi-Fi and DSRC bands.

As seen from FIG. 1, the antenna 10 cuts the left corner and makes a slope from the left bottom to the right top corner, so it will fit well within a shark-fin cover. The half-circle and the slopping curve on the right of the back side mainly contribute to the cellular band radiation. To maintain the lowest frequency band for LTE, a tail-shape portion is added to the right top corner, which reduces the lowest frequency point of the low band of LTE to 700 MHz with a reflection coefficient of −9 dB. With such structure, the size of the horizontal substrate 12 can conform with the footprint of the shark-fin cover. The upper left sloping curve also contributes to the matching and bandwidth enhancement of the LTE bands. By changing the curvature of the curve, the bandwidth of the LTE band may be changed. The LTE port (i.e., the second port 20) can cover frequency bands from 700 MHz to 1.2 GHz and from 1.425 GHz to 2.7 GHz, which supports the 1.5 GHz band, which is the cellular band for Japan. Therefore, it is suitable for use in Europe, the United States and Japan.

Figure 3:
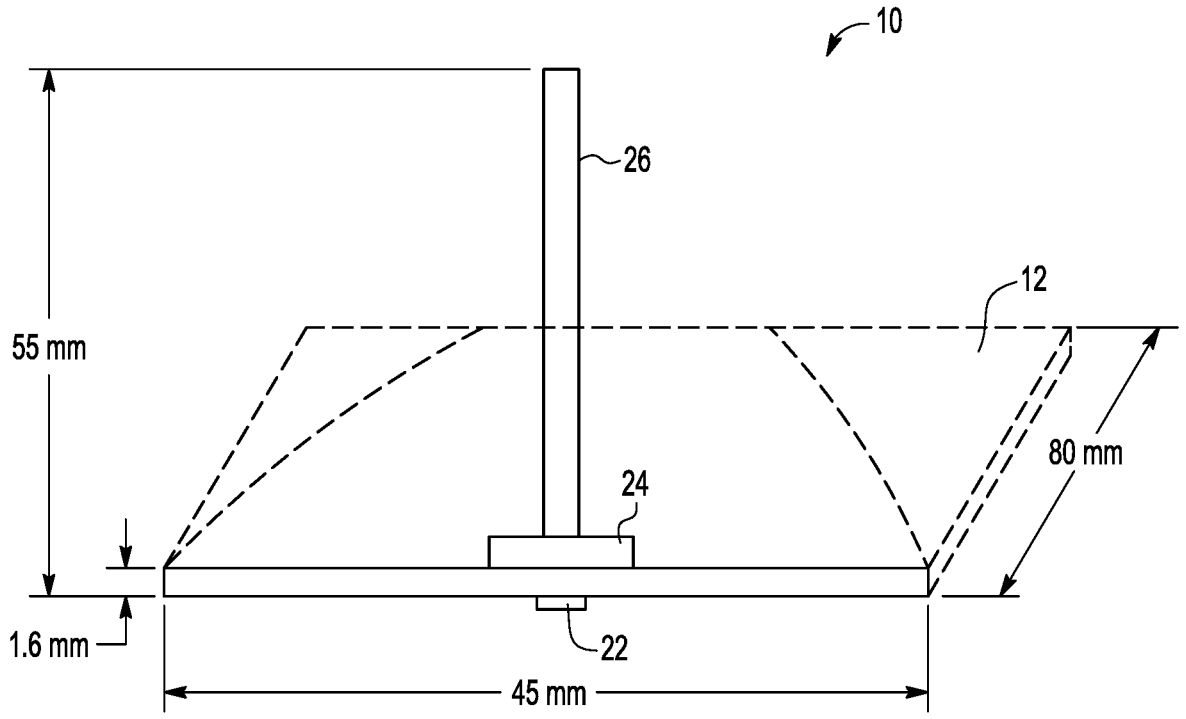
FIG. 3 is a front view of the antenna of FIGS. 1 and 2.

FIG. 3 is a front view of the antenna 10 of FIGS. 1 and 2, and shows the base substrate 12, the third port 22, the GPS antenna unit 24, and the radiating substrate 26. Although the base substrate 12 is shown as being rectangular, the base substrate 12 may be somewhat tear-drop shaped such that it can fit within commercially known vehicle shark-fin assemblies or housings.

Due to the geometries of the antenna, including the feed strips 44 and 52, and the wide-slots 54 and 62, the antenna 10 achieves radiation patterns at the Wi-Fi and DSRC bands with omni-directional characteristics with a gain variation of about 6 dB and a minimum gain of greater than −4 dBi. Further, isolation between the first and second ports 18 and 20 is better than −9 dB. In one embodiment, the base substrate has dimensions on the order of 80 mm×45 mm×1.6 mm, the radiating substrate has dimensions on the order of 81 mm×53.4 mm×1.6 mm, and a center-to-center distance between the first and second ports is about 23 mm.

A prototype of an antenna in accordance with the present invention has been constructed. Graphs showing comparisons between simulations and measurements for the prototype are shown in FIGS. 4-9. The simulations were performed using Ansys High Frequency Structural Simulator (HFSS) software.

Figure 4:
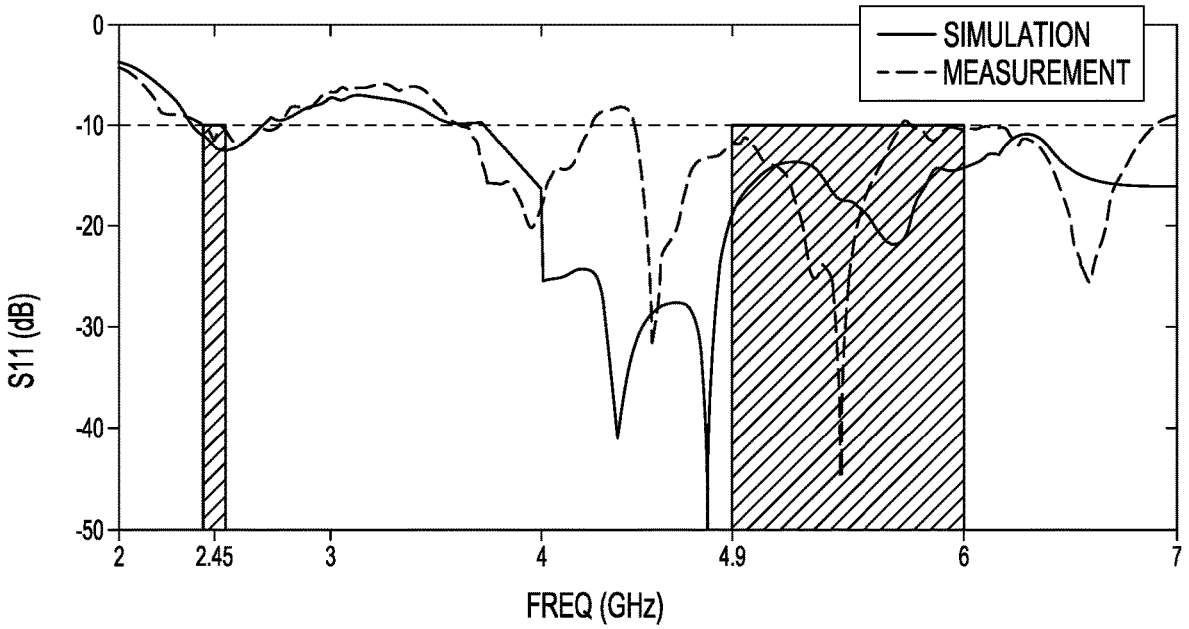
FIG. 4 is a graph showing simulated and measured reflection coefficients for the first port of the antenna of FIGS. 1-3.
Figure 5:
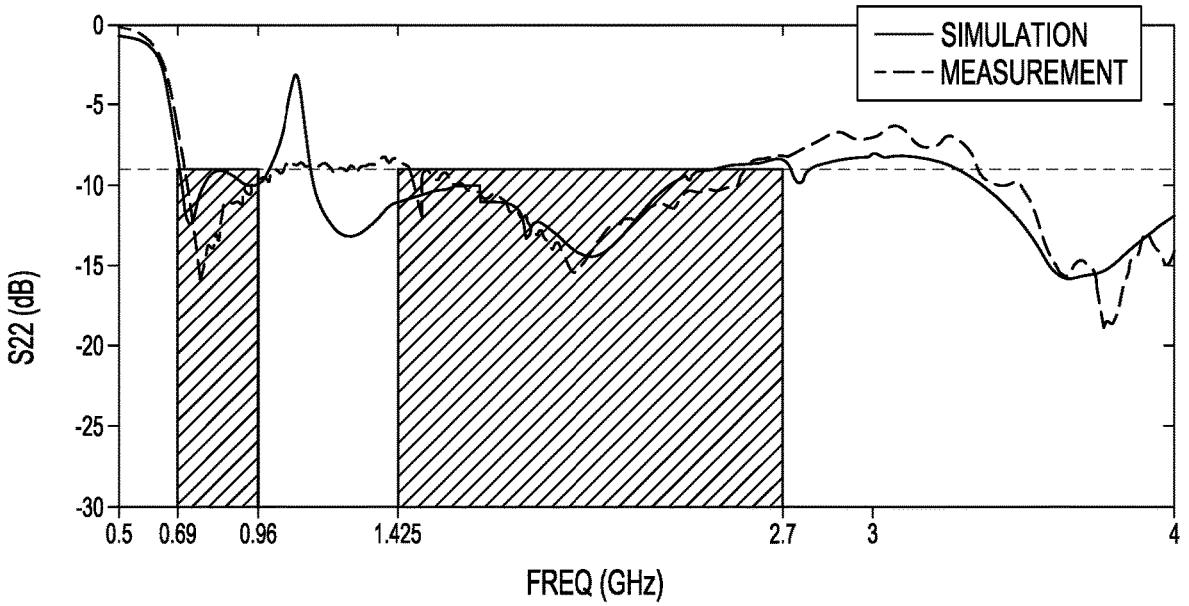
FIG. 5 is a graph showing simulated and measured reflection coefficients for the second port of the antenna of FIGS. 1-3.

FIG. 4 is a graph showing simulated and measured reflection coefficients for the first port 18 of the antenna 10, and FIG. 5 is a graph showing simulated and measured reflection coefficients for the second port 20 of the antenna 10. As previously noted, the first port 18 is for Wi-Fi and DSRC bands, and the second port 20 is for cellular bands. The measured reflection coefficients have good agreement with the simulated reflection coefficients.

Figure 6A:
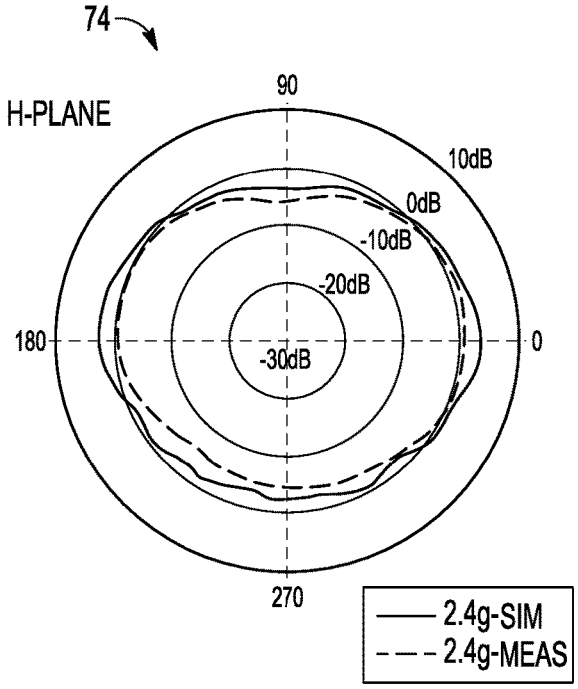
FIGS. 6(A) and 6(B) are graphs comparing simulated and measured radiation patterns of the first port of the antenna of FIGS. 1-3 at 2.4 GHz and 5 GHz, respectively.
Figure 6B:
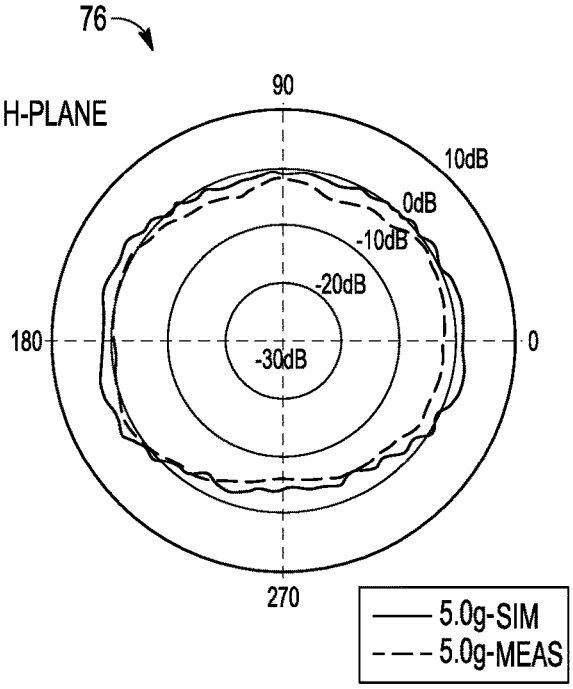
Figure 7:
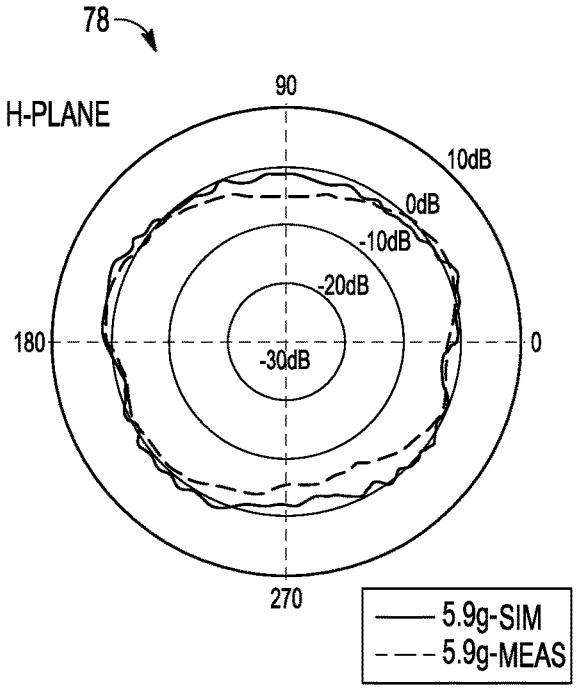
FIG. 7 is a graph showing simulated and measured radiation patterns of the first port of the antenna of FIGS. 1-3 at 5.9 GHz.
Figure 8A:
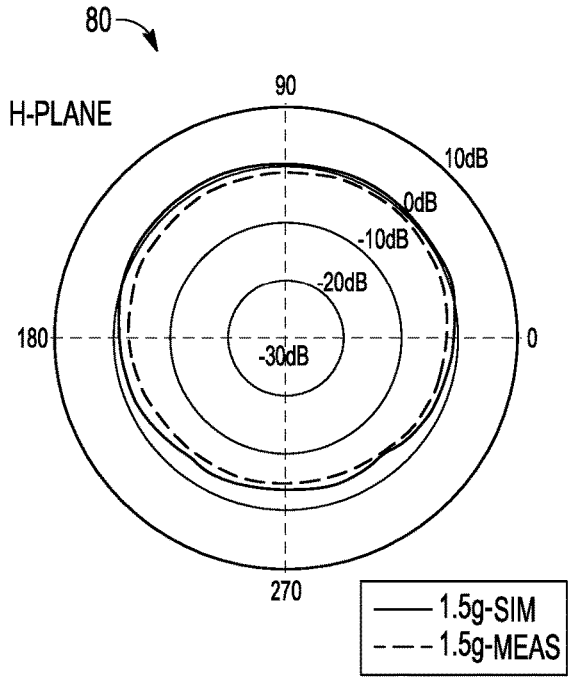
FIGS. 8(A) and 8(B) are graphs showing simulated and measured radiation patterns of the second port of the antenna of FIGS. 1-3 at 1.5 GHz and 2.2 GHz, respectively.
Figure 8B:
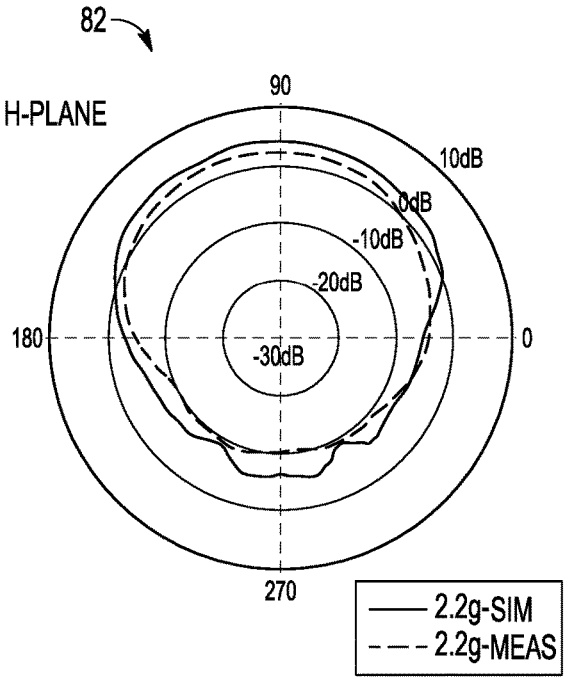
Figure 9:
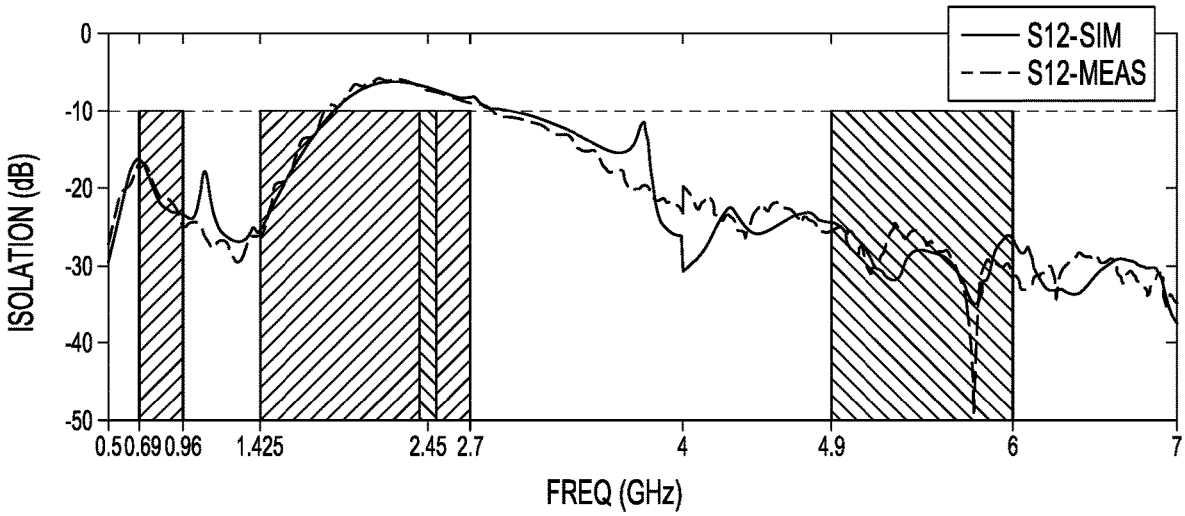
FIG. 9 is a graph showing simulated and measured isolation between the first and second ports of the antenna of FIGS. 1-3.

FIGS. 6-8 show comparisons of the simulated and measured radiation patterns at different frequencies for the two ports 18 and 20 of the antenna 10. More particularly, FIGS. 6(A) and 6(B) are graphs comparing simulated and measured radiation patterns of the first port 18 at Wi-Fi frequency bands, where FIG. 6(A) shows a graph 74 at 2.4 GHz and FIG. 6(B) shows a graph 76 at 5 GHz. FIG. 7 is a graph 78 showing simulated and measured radiation patterns of the first port 18 at 5.9 GHz for DSRC. FIGS. 8(A) and 8(B) are graphs 80 and 82 showing simulated and measured radiation patterns of the second port 20 of the antenna 10 at 1.5 GHz and 2.2 GHz, respectively, for LTE. FIG. 9 is a graph 84 showing simulated and measured isolation between the first and second ports 18 and 20 of the antenna 10.

The comparisons shown in FIGS. 4-9 illustrate that the simulated and measured radiation patterns have similar shapes. A gain difference between the simulated and measured results can be observed, which is expected as losses and measurement errors are encountered in an actual measurement system. Also observed from the radiation pattern results is that the minimum gain obtained in the practical measurement at 5.9 GHz is −6 dBi and the gain variation is within 8 dB, which is better than presently known MIMO antennas, and acceptable in vehicle communication systems.

The isolation between the two ports 18 and 20 at different frequency bands are also measured and compared to the simulated results. The comparison is shown in FIG. 9. There is a good agreement with the simulated and measured isolation. The isolation across most of the bands are below −10 dB. Isolation level at Wi-Fi-2.4 GHz band and LTE2600 band is a bit lower (around −5 dB). As the two frequency bands overlap, the mutual coupling and leakage between the two ports 18 and 20 are larger. However, the isolation level can be improved by introducing extra filtering at the electronic circuit level, as will be understood by those of skill in the art.

The antenna 10 can fit well in a typical shark-fin cover while maintaining good performance for a number of V2X applications, including Wi-Fi, Bluetooth, Cellular and DSRC applications, in an intelligent transportation system. The antenna 10 can be integrated directly with a commercial GPS antenna, such as shown in FIGS. 1-3 using the GPS antenna unit 24 to form a shark-fin unit that can be mounted on the roof of a car. One advantage of the antenna 10 is that the distance between the first and second ports 18 and 20, as well as the distance between GPS port 22 and the ports 18 and 20, are kept very small, making it possible to integrate circuit components within a small area. Another advantage is that the antenna 10 has a reflection coefficient better than −6 dB and there is negligible mutual coupling.

The antenna 10 covers seven bands, including GPS, DSRC, WLAN (Wi-Fi 2.4G and Wi-Fi 5G), Bluetooth, and cellular (European cellular bands, one low band, and one high band), and the whole LTE band (more than just 824-894 MHz). The antenna 10 provides low isolation, which can be improved further using external filtering. Furthermore, the antenna 10 is small in size, limited to just 95 mm×45 mm×55 mm (L×W×H) using a horizontal PCB (base substrate 12), and a vertical PCB (radiating substrate 26).

The antenna 10 is constructed using only a base substrate 12 and a radiating substrate 26. The antenna 10 covers from 700 MHz cellular band to 6 GHz band, and can be used for most of the applications in an ITS system, including cellular, Wi-Fi-2.4 GHz and Bluetooth, Wi-Fi-5 GHz, and DSRC. The antenna 10 works well across all the frequency bands and maintains good radiation pattern characteristics for these bands. High antenna gain also is achieved for these bands. The radiation patterns at the Wi-Fi and DSRC bands achieve omni-directional characteristics with a gain variation of 6 dB and a minimum gain of a value higher than −4 dBi. The center-to-center distance between the first and second ports 18 and 20 is only 23 mm, yet the isolation between the ports 18 and 20 achieves a good level (−10 dB) across almost the entire bands, except the overlapping frequency band between Wi-Fi-2.4 GHz and LTE1700 to LTE2600 band, but the low isolation can be readily improved using external filtering circuitry. The antenna 10 is able to operate at all the necessary frequency bands with good return loss performance (better than −9 dB) and good radiation patterns (larger gain and omni-directional coverage), yet still is small in size. The antenna 10 is quite easy to fabricate, so the cost of the antenna can be kept low. The antenna 10 has a sloping shape in front, which makes it a good fit for a typical shark-fin unit mounted on the top of a car. The integration of the GPS antenna module 24 also is easy without significant mutual interference.

As used herein, a curve means any line that does not take a direct straight path between its two end points. The curve can include two or more straight lines that are joined together and are not parallel with each other. The curve does not need to be a line that constantly deviates from being straight for all its length.

In the claims, the word 'comprising' or 'having' does not exclude the presence of other elements or steps then those listed in a claim. Furthermore, the terms "a" or "an," as used herein, are defined as one or more than one. Also, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an". The same holds true for the use of definite articles. Unless stated otherwise, terms such as "first" and "second" are used to arbitrarily distinguish between the elements such terms describe. Thus, these terms are not necessarily intended to indicate temporal or other prioritization of such elements. The mere fact that certain measures are recited in mutually different claims does not indicate that a combination of these measures cannot be used to advantage.

In the foregoing specification, the invention has been described with reference to specific examples of embodiments of the invention. It will, however, be evident that various modifications and changes may be made therein without departing from the broader spirit and scope of the invention as set forth in the appended claims.

The invention claimed is:

1. A multi-band antenna, comprising:

a base substrate having opposing upper and lower surfaces;

a first port for communicating first transmission signals in a first frequency band, wherein the first port is located at a first location in the base substrate;

a second port for communicating second transmission signals in a second frequency band that is different from the first frequency band, wherein the second port is located at a second location in the base substrate;

a base conductor integrated with the base substrate;

a radiating substrate that is transversely aligned with reference to the base substrate, the radiating substrate including:

first and second opposing major surfaces, wherein the first major surface comprises an insulator and the second major surface comprises a conductor;

a base edge that is adjacent to the upper surface of the base substrate, wherein the base edge extends between a front corner and a back corner;

a front edge that extends between the front corner and a top corner;

a back edge that extends between the back corner and the top corner, wherein the first and second major surfaces are bounded by the base edge, the front edge and the back edge;

a first conductive feed strip formed on the first major surface, wherein the first feed strip has a vertical extending portion and is galvanically connected to the first port; and a second conductive feed strip formed on the first major surface, wherein the second feed strip is galvanically connected to the second port, wherein the second major surface is capacitively coupled to the first and second feed strips and galvanically connected to the base substrate;

a first wide-slot formed on the second major surface, wherein the first wide-slot enables the antenna to radiate at the first frequency band as a wide-slot monopole antenna; and a second wide-slot formed on the second major surface, wherein the second wide-slot extends from the back edge to a location between the first and second ports.

2. The multi-band antenna of claim 1, wherein the first port is located in the base edge proximate to the front corner and the second port is located in the base edge between the first port and the back corner.

3. The multi-band antenna of claim 1, wherein the front edge is curved between the front corner and the top corner.

4. The multi-band antenna of claim 1, wherein the top corner of the radiating substrate is longitudinally aligned at a position that is beyond the back corner of the radiating substrate.

5. The multi-band antenna of claim 4, wherein the back edge of the radiating substrate comprises a curve that extends from the top corner to the back corner, such that the radiating substrate has a shark-fin shape.

6. The multi-band antenna of claim 1, wherein the first feed strip has one or more vertical and horizontal portions disposed between the extending-portion and the first port.

7. The multi-band antenna of claim 6, wherein transitions between the one or more vertical and horizontal portions comprise right angle bends with cut corners, which allow for positioning of the extended-portion.

8. The multi-band antenna of claim 7, wherein the extending-portion of the first feed strip is offset from a center of the first wide-slot in order to point a radiation pattern more to one side of the antenna.

9. The multi-band antenna of claim 1, wherein the second feed strip has a width that increases as a function of distance from the second port such that the second feed strip is fan-shaped.

10. The multi-band antenna of claim 1, wherein the first wide-slot is rectangular.

11. The multi-band antenna of claim 10, wherein the first wide-slot includes a narrow horizontal slot that is spaced from and extends parallel to a horizontal side of the first wide-slot.

12. The multi-band antenna of claim 11, wherein the first wide-slot includes a narrow vertical slot that is spaced from and extends parallel to a vertical side of the first wide-slot.

13. The multi-band antenna of claim 1, wherein the second wide-slot extends the back edge to a location in the base edge between the first and second ports.

14. The multi-band antenna of claim 13, wherein the second wide-slot has a sloping curve.

15. The multi-band antenna of claim 14, wherein the second wide-slot includes a half-circle shaped portion located between the first and second ports.

16. The multi-band antenna of claim 1, further comprising:

a third port disposed in the base substrate, the third port for communicating third transmission signals; and a GPS antenna unit mounted on the upper surface of the base substrate and connected to the third port.

17. The multi-band antenna of claim 1, wherein:

the first port is located in the base edge proximate to the front corner and the second port is located in the base edge between the first port and the back corner;

the front edge is curved between the front corner and the top corner;

the top corner of the radiating substrate is longitudinally aligned at a position that is beyond the back corner of the radiating substrate;

the back edge of the radiating substrate comprises a curve that extends from the top corner to the back corner, such that the radiating substrate has a shark-fin shape;

the radiating substrate comprises a two-sided printed circuit board having a thickness of about 1.6 mm and a dielectric constant of about 4.4.

18. The multi-band antenna of claim 17, wherein:

the first transmission signals of the first port comprise Wi-Fi and Dedicated Short Range Communications (DSRC) frequency band signals; and the second transmission signals of the second port comprise cellular frequency band signals that cover from 700 MHz to 1.2 GHz and 1.425 GHz to 2.7 GHz.

19. The multi-band antenna of claim 18, wherein:

radiation patterns at the Wi-Fi and DSRC bands achieve omnidirectional characteristics with a gain variation of about 6 dB and a minimum gain of greater than −4 dBi; and isolation between the first and second ports is better than −9 dB.

20. The multi-band antenna of claim 1, wherein:

the base substrate has dimensions on the order of 80 mm×45 mm×1.6 mm;

the radiating substrate has dimensions on the order of 81 mm×53.4 mm×1.6 mm; and a center-to-center distance between the first and second ports is about 23 mm.

* * * * *